United States Patent [19]

Rupar

[11] Patent Number: 5,058,806

[45] Date of Patent: Oct. 22, 1991

[54] STREAM PROPELLED ROTARY POP-UP SPRINKLER WITH ADJUSTABLE SPRINKLING PATTERN

[75] Inventor: Robert L. Rupar, Walla Walla, Wash.

[73] Assignee: Nelson Irrigation Corporation, Walla Walla, Wash.

[21] Appl. No.: 466,020

[22] Filed: Jan. 16, 1990

[51] Int. Cl.[5] ..... B05B 3/04; B05B 15/10

[52] U.S. Cl. ..... 239/205; 239/206; 239/222.17; 239/252; 239/437; 239/451; 239/DIG. 1

[58] Field of Search ..... 239/222.11, 222.17, 239/252, 437, 451, DIG. 1, 204–206

[56] References Cited

U.S. PATENT DOCUMENTS

| | | | |
|---|---|---|---|
| Re. 32,386 | 3/1987 | Hunter | 239/206 |
| D. 259,438 | 6/1981 | Meyer | D23/35 |
| D. 299,156 | 12/1988 | Heren | D23/214 |
| 275,124 | 5/1883 | Blumenberg et al. . | |
| 458,607 | 9/1891 | Weiss | D23/214 |
| 535,655 | 3/1895 | Anderson | D23/214 |
| 1,510,930 | 3/1922 | Enell | D23/214 |
| 1,821,579 | 11/1929 | Rader | D23/214 |
| 1,919,244 | 5/1930 | Munz | D23/214 |
| 2,108,787 | 2/1938 | Coles et al. | D23/214 |
| 2,128,552 | 8/1938 | Rader et al. | D23/214 |
| 2,273,401 | 2/1942 | Ferrando et al. | D23/214 |
| 2,488,234 | 11/1949 | Perry | D23/214 |
| 2,493,595 | 1/1950 | Rieger | D23/214 |
| 2,796,293 | 6/1957 | Becker | D23/214 |
| 2,990,120 | 6/1961 | Reynolds | D23/214 |
| 3,006,558 | 10/1961 | Jacobs . | |
| 3,415,258 | 12/1968 | Gilson | 134/179 |
| 3,454,225 | 7/1969 | Hunter | 239/498 |
| 3,468,485 | 9/1969 | Sully | 239/261 |
| 3,580,514 | 5/1971 | Radecki | 239/521 |
| 3,651,903 | 3/1972 | Butler et al. . | |
| 3,713,584 | 1/1973 | Hunter | 239/206 |
| 3,724,757 | 4/1973 | Hunter | 239/205 |
| 3,848,675 | 11/1974 | Evans | 169/15 |
| 3,854,664 | 12/1974 | Hunter | 239/206 |
| 3,861,503 | 1/1975 | Nash | 188/276 |
| 3,865,216 | 2/1975 | Gryglas | 188/290 |
| 3,921,910 | 11/1975 | Hayes et al. | 239/205 |

(List continued on next page.)

FOREIGN PATENT DOCUMENTS

| | | | |
|---|---|---|---|
| 48682 | 7/1971 | Australia . | |
| 1632916 | 8/1970 | Fed. Rep. of Germany . | |
| 1321580 | 2/1963 | France . | |
| 675793 | 11/1964 | Italy | 239/252 |
| 1256534 | 12/1971 | United Kingdom . | |
| 2019704 | 11/1979 | United Kingdom . | |
| 2118460 | 11/1983 | United Kingdom | 239/437 |

OTHER PUBLICATIONS

Nifco specification sheet.

*Primary Examiner*—Andres Kashnikow
*Assistant Examiner*—William Grant
*Attorney, Agent, or Firm*—Nixon & Vanderhye

[57] ABSTRACT

A pop-up, rotating stream sprinkler device includes an outer housing having a first longitudinal axis, an inlet end adapted for connection to a source of liquid under pressure, a first inner housing telescopically mounted within the outer housing for movement between retracted and extended positions, and having a second longitudinal axis coincident with the first longitudinal axis, and an outlet end provided with a first arcuate slot adapted to discharge a stream of liquid under pressure. A non-rotatable shaft supports at one end thereof a substantially hollow distributor for rotation thereon downstream of the outlet. The other end of the shaft is fixedly mounted in the first inner housing, and the hollow distributor includes an interior chamber enclosing a brake assembly for retarding the rotation of the distributor. A nozzle disk is removably and rotatably secured to the first inner housing and provided with at least one discharge orifice, so that the nozzle is rotatable to align any part of the at least one discharge orifice with the arcuate slot.

30 Claims, 3 Drawing Sheets

U.S. PATENT DOCUMENTS 3,934,820 1/1976 Phaup ..... 239/205
3,955,764 5/1976 Phaup ..... 239/206
3,977,063 8/1976 Bruninga ..... 29/157
4,121,769 10/1978 Drori ..... 239/222.17
4,131,234 12/1978 Pescetto ..... 239/457
4,181,259 1/1980 Ridgway ..... 239/206
4,189,099 2/1980 Bruninga ..... 239/200
4,201,344 5/1980 Lichte ..... 239/242
4,221,333 9/1980 Rodriguez ..... 239/255
4,261,515 4/1981 Rosenberg et al. ..... 239/222.17
4,322,860 4/1982 Gould ..... 4/490
4,331,294 5/1982 Gilad ..... 239/222.17
4,353,506 10/1982 Hayes ..... 239/206
4,356,972 11/1982 Vikre ..... 239/177
4,432,495 2/1984 Bruninga ..... 239/205
4,440,345 4/1984 Figwer et al. ..... 239/214
4,471,908 9/1984 Hunter ..... 239/11
4,492,339 1/1985 Kreitzberg ..... 239/230
4,498,628 2/1985 Tucker ..... 239/381
4,501,391 2/1985 Hunter ..... 239/DIG. 1 X
4,560,108 12/1985 Rubinstein ..... 239/222.17
4,565,266 1/1986 Omata ..... 188/322.5
4,624,412 11/1986 Hunter ..... 239/232
4,634,052 1/1987 Grizzle et al. .
4,650,118 3/1987 Saarem et al. .
4,660,766 4/1987 Nelson et al. ..... 239/222.17
4,687,139 8/1987 Lockwood ..... 239/205
4,718,605 1/1988 Hunter ..... 239/242
4,749,112 6/1988 Ash ..... 239/14.2
4,754,925 7/1988 Rubinstein ..... 239/230
4,781,327 11/1988 Lawson et al. ..... 239/203
4,796,809 1/1989 Hunter ..... 239/205
4,796,811 1/1989 Davisson ..... 239/222.17
4,815,662 3/1989 Hunter ..... 239/222.17
4,842,201 6/1989 Hunter ..... 239/396
4,867,378 9/1989 Kah, Jr. ..... 239/DIG. 1 X
4,886,211 12/1989 Cohen ..... 239/222.17
4,944,456 7/1990 Zakai ..... 239/DIG. 1
5,007,586 4/1991 Cohen ..... 239/222.17

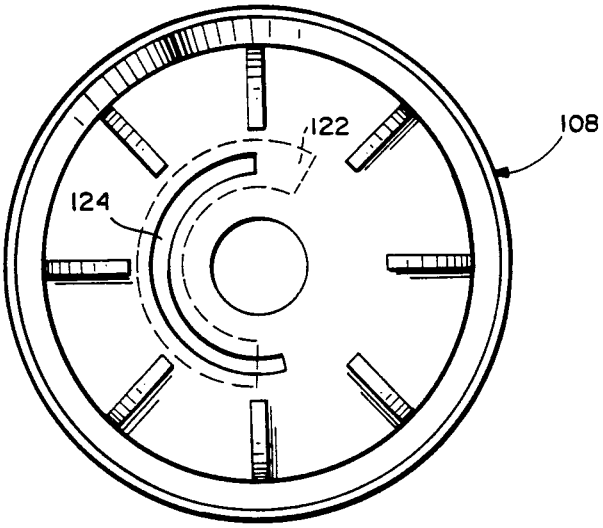
FIG. 4
FIG. 5
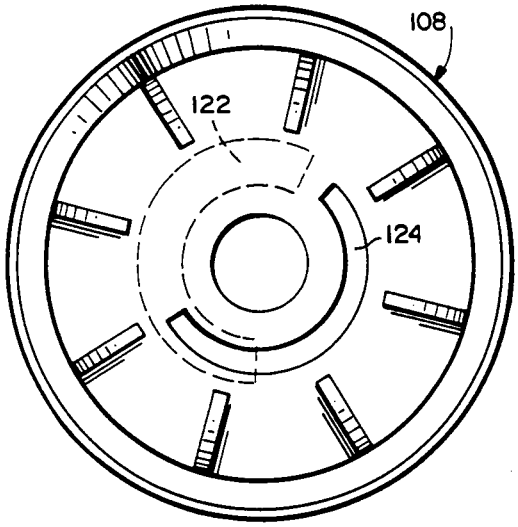
FIG. 6
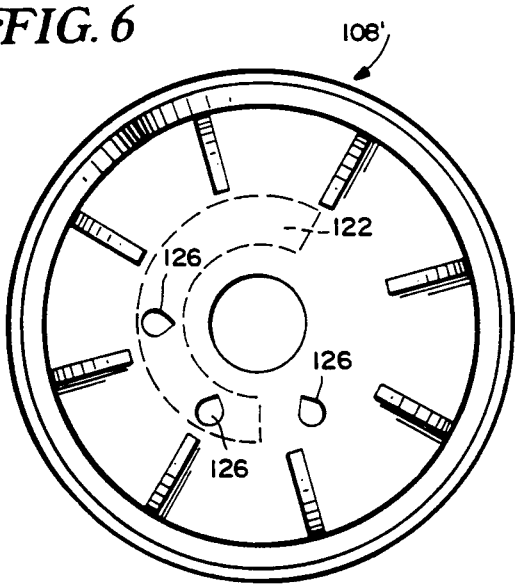

STREAM PROPELLED ROTARY POP-UP SPRINKLER WITH ADJUSTABLE SPRINKLING PATTERN

BACKGROUND AND SUMMARY OF THE INVENTION

This invention relates generally to sprinkler devices and, more specifically, to rotary sprinkler devices of the pop-up type. These are devices which are designed for in-ground installation typically used in automatic sprinkler systems, and where the sprinkler head moves from a below ground inoperative position, to an above ground operative position in response to the flow of water under pressure.

Rotary sprinklers of the pop-up type are well represented in the patent literature. See for example, U.S. Pat. Nos. 32,386; 3,713,584; 3,724,757; and 3,921,910. In addition, U.S. Pat. No. 3,934,820 describes a rotary pop-up sprinkler which utilizes a gear train to reduce the rotational speed of the rotary nozzle. Reversible, turbine driven sprinkler heads are described in U.S. Pat. Nos. 4,201,344 and 4,624,412. A two-stage pop-up rotary sprinkler is disclosed in U.S. Pat. No. 4,796,809, while the utilization of a viscous brake for controlling nozzle rotation in a pop-up sprinkler is described in U.S. Pat. No. 4,815,662.

Commonly owned prior U.S. Patent Nos. 4,660,766 and 4,796,811 disclose rotary sprinklers of a non pop-up type which incorporate viscous speed reducing assemblies for slowing the rotational speed of a rotary distributor driven by a water stream discharged from an otherwise stationary nozzle.

The present invention relates to a stream propelled rotary sprinkler of the pop-up type which is characterized by improved performance, simplified construction and lower cost than prior sprinklers of the same or similar type, as explained in greater detail below.

In a preferred embodiment, the device includes an outer housing or stem designed for in-ground installation, and first and second inner housings or stems telescopically mounted within the outer housing. Upon commencement of flow of water under pressure into the sprinkler device, the first and second inner housings are extended to an above ground position, and the first inner housing is then further extended relative to the second inner housing to a fully extended, operative position. The first and second inner housings are normally spring biased to the below ground, inoperative position so that, upon cessation of the supply of water under pressure, the first and second inner housings will return automatically to a below ground, inoperative position within the outer housing.

It will be appreciated that, if desired, the second (or intermediate) housing may be omitted so that only a single telescoping arrangement is employed. In this event, of course, the first inner housing would be lengthened so that the desired extension will occur.

The first inner housing is provided with a rotatable nozzle disk formed with at least one discharge orifice for discharging the stream of water under pressure. The discharge orifice preferably is in the form of an arcuate slot, extending slightly more than 180° about the disk center, which coincides with the longitudinal axis of each of the three housings.

The first inner housing is also provided with an outlet end including a second arcuate slot through which water is discharged from the interior of the sprinkler. In a preferred embodiment, this second slot also extends slightly more than 180°, and preferably about 200°, about the longitudinal axis of the inner housing. In addition, the width of this second slot is greater than the width of the first slot formed in the nozzle disk. The nozzle disk is located adjacent and downstream of the outlet end of the first inner housing so that the first and second slots lie in back-to-back relationship. Moreover, the first and second slots are radially located such that the nozzle slot is rotatable into and out of alignment with the outlet end slot, and within the width of the outlet end slot. Thus, it will be appreciated that the nozzle slot serves to open any increment or substantially all of the outlet end slot so as to permit virtually infinite arcuate sprinkling patterns from between about 0° and about 180° degrees.

Water under pressure issuing from the nozzle disk impinges on a rotary distributor which, in turn, redirects and distributes the water over a predetermined area as will be described in greater detail further herein.

In an alternative arrangement, the nozzle disk can be provided with a plurality of apertures arranged in a circular pattern and selectively movable into the outlet end slot area by rotation of the nozzle disk. Variations in the shape, number and spacing of such apertures are within the scope of this invention.

In another aspect of the present invention, the rotary distributor itself encloses a "rotor motor", or viscous speed reducing assembly, for slowing the rotational speed of the distributor which would otherwise rotate at high speed (e.g., about 1800 rpm or more) as a result of the direct impingement of the pressurized stream on slightly radially offset grooves formed in a lower face of the distributor.

The viscous brake assembly is generally similar to that disclosed in commonly owned U.S. Pat. Nos. 4,660,766 and 4,796,811, and recently filed copending application Ser. No. 07,390,286, filed Aug. 7, 1989, with the exception that in the present invention, the shaft and stator member are fixed against rotation, and the stator is enclosed within the rotary distributor.

The combined distributor and speed reducing or brake assembly includes a shaft, one end of which is fixed, i.e., non-rotatably mounted, within the first inner housing, and the other end of which supports the distributor for rotation relative to the fixed shaft, downstream of the nozzle disk discharge orifice. A stator member or drum is mounted on the shaft within a sealed chamber formed by the distributor, and the remaining space in the chamber is filled with a viscous fluid.

The brake device operates on a viscous shear principle whereby viscous liquid between the stator and rotary distributor is caused to shear as the distributor rotates in close relationship to the stationary stator member in the hollow distributor.

The brake assembly is effective to reduce the rotational speed of the distributor from an unbraked speed of about 1800 rpm or more, for a given typical pressure level, to a desired speed of from about $\frac{1}{4}$ to 12 rpm at the same pressure. Such speed reduction maximizes the "throw" of the water, while minimizing the well known and undesirable "horse tail" effect which is otherwise experienced at high rotational speeds.

The lower radial face of the rotary distributor in accordance with an exemplary embodiment of the invention is provided with a plurality of radially outwardly and upwardly extending grooves that are slightly radially offset, so that when the stream of water impinges on the grooves, rotary motion is imparted to the distributor. This aspect of the invention is similar to that described in the above-identified copending application.

It will be appreciated that the viscous brake assembly and discharge outlet arrangement of the present invention have many advantages over sprinkler constructions in the prior art. For example, the isolation of the brake assembly away from the sprinkler housing eliminates any need for dynamic shaft seals otherwise required to prevent pressurized water from entering the viscous brake assembly housing. Any water that does contact the shaft externally of the housing has already been discharged from the nozzle disk into atmospheric space, and is at minimal or at least substantially reduced pressure.

At the same time, the adjustable nozzle disk may be rotated manually to create an arcuate discharge slot of from anywhere from close to 0° degrees to about 180° degrees, thereby substantially eliminating the need for maintaining a large number of differently configured nozzle disks.

Thus, in one aspect, the present invention relates to a pop-up, rotating stream sprinkler device comprising:

an outer housing having a first longitudinal axis, and an inlet end adapted for connection to a source of liquid under pressure;

a first inner housing telescopically mounted within the outer housing for movement between retracted and extended positions, and having a second longitudinal axis coincident with the first longitudinal axis, and an outlet end adapted to discharge to atmosphere a stream of liquid under pressure;

a non-rotatable shaft, one end of the shaft supporting a substantially hollow rotary distributor for rotation thereon downstream of the outlet end, and the other end of the shaft fixedly mounted in the first inner housing, and wherein the distributor encloses a brake assembly for retarding rotation of the distributor.

In another aspect, the present invention is directed to a rotary distributor for use with a stream propelled sprinkler, the distributor comprising:

a shaft;

a substantially hollow body portion mounted for rotation on one end of the shaft, the substantially hollow body portion including a brake chamber;

a stator member fixedly secured to the one end of the shaft and located within the brake chamber; and a viscous fluid within the chamber for effecting braking action on the distributor upon relative rotation between the distributor and the stator member.

It will be understood that the above described rotary distributor may be used in pop-up as well as non pop-up sprinkler devices.

It will thus be appreciated that the sprinkler device as disclosed herein provides a simplified construction which improves performance by maximizing the throw of the water stream via a simple but effective viscous brake assembly, while reducing cost and increasing durability by eliminating the need for pressurized dynamic shaft seals and other drive components typically utilized in such sprinklers, and by providing a virtually infinitely adjustable nozzle arrangement for creating desired arcuate spray patterns.

Other objects and advantages of the present invention will become apparent from the detailed description of the invention which follows.

BRIEF DESCRIPTION OF THE DRAWINGS

FIGS. 4 and 5 are top views of a nozzle disk in accordance with the invention, showing a nozzle slot in different positions relative to a hidden outlet end slot; and FIG. 6 is a top view of another nozzle disk in accordance with another embodiment of the invention.

DETAILED DESCRIPTION OF THE DRAWINGS

Figure 1:
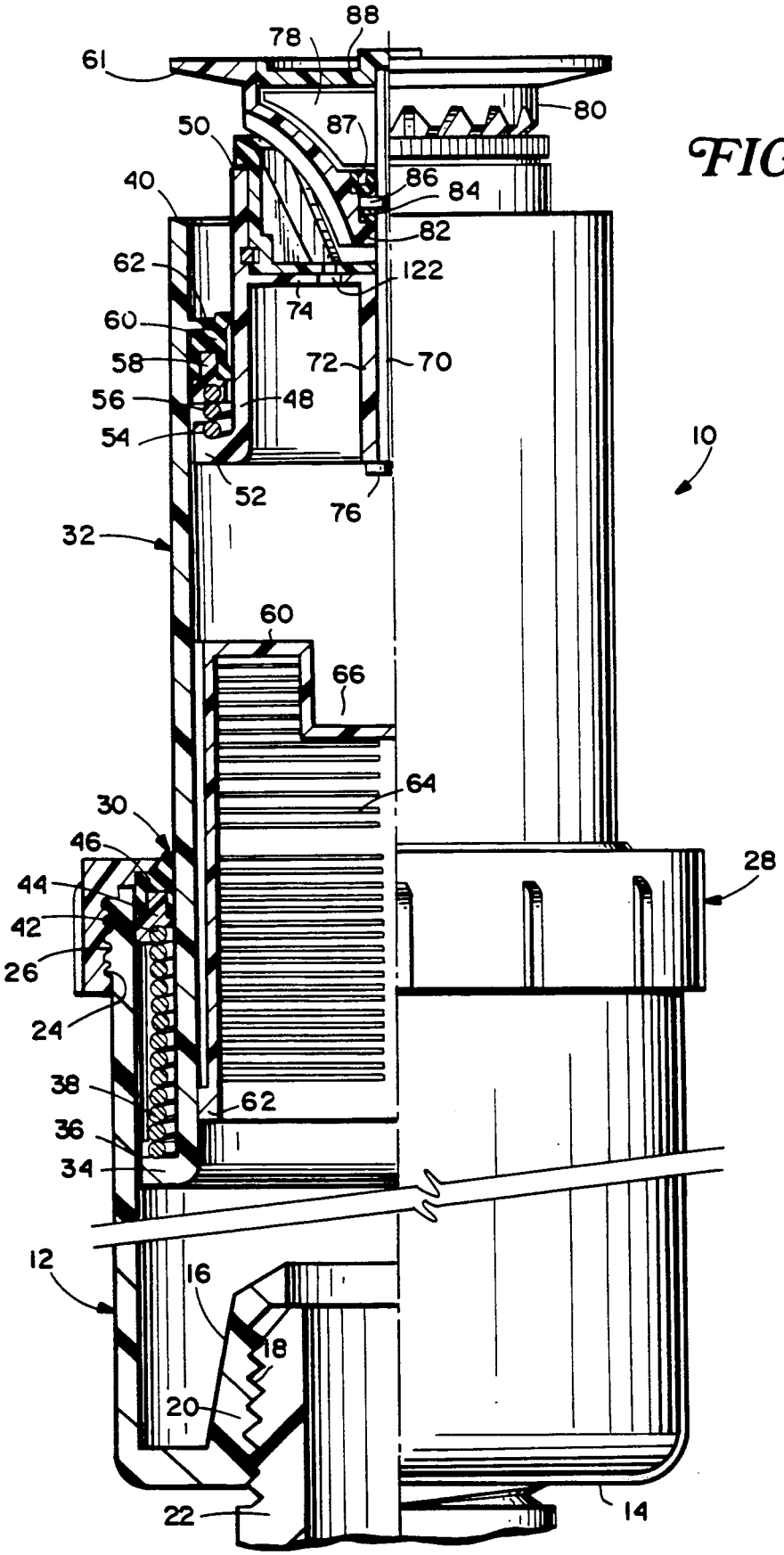
FIG. 1 is a side view, partially in section, illustrating a pop-up type sprinkler in accordance with one exemplary embodiment of the invention, in an above ground, operative or extended position.
Figure 2:
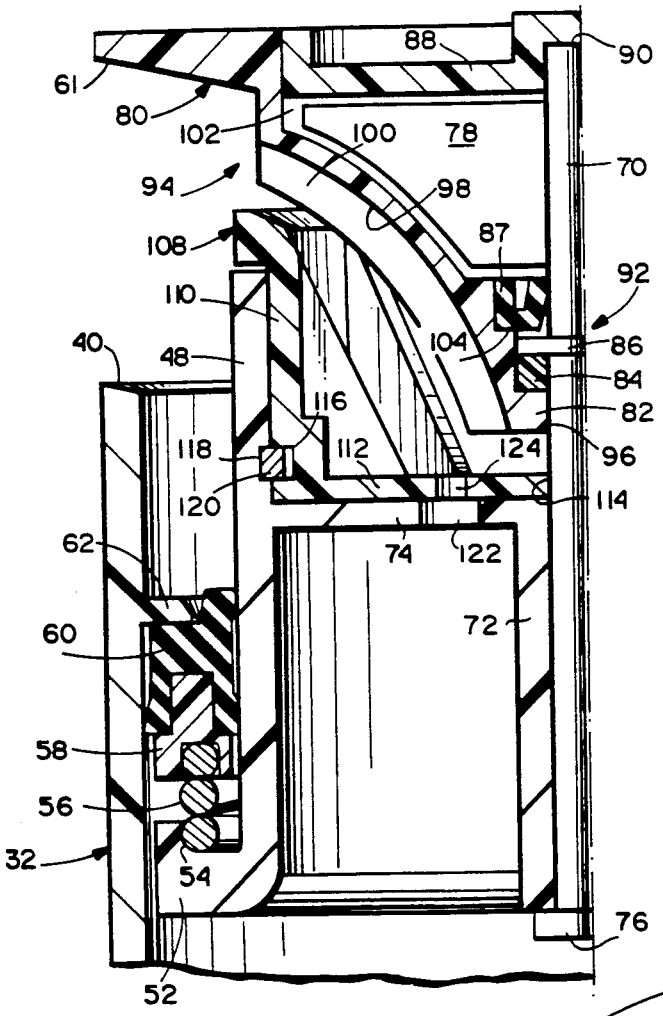
FIG. 2 is an enlarged detail of the outlet end of the sprinkler illustrated in FIG. 1.
Figure 3:
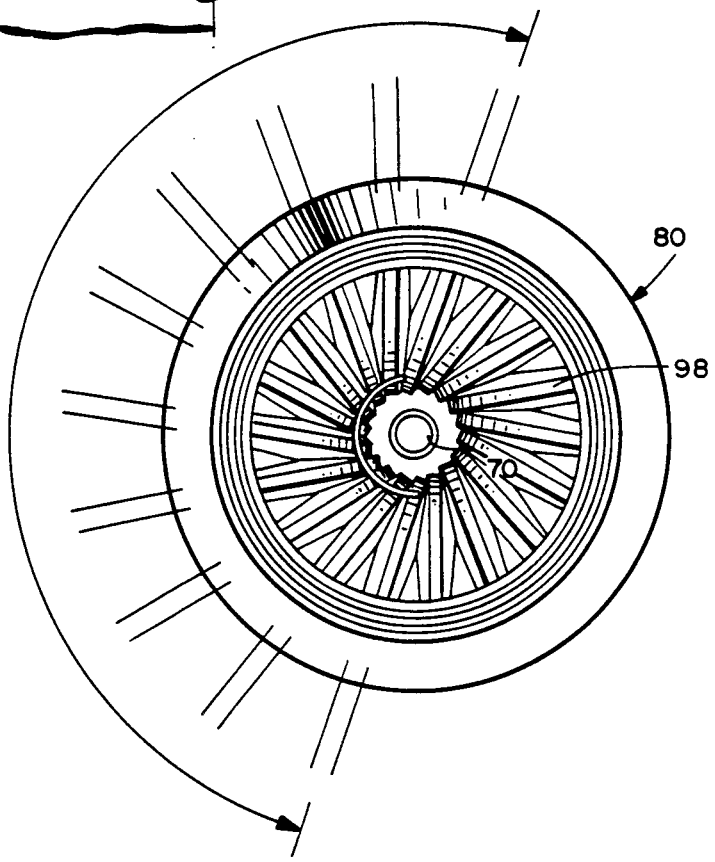
FIG. 3 is a bottom view of a rotary distributor in accordance with the invention, and showing a phantom impingement pattern from an associated nozzle slot.

With reference now particularly to FIGS. 1 and 2, there is illustrated a pop-up sprinkler 10 in accordance with an exemplary embodiment of the invention. The sprinkler includes an outer, substantially cylindrical housing or stem 12 provided with a bottom wall 14. The bottom wall 14 is formed with a centrally located, inlet port 16 having threads 18 for engaging corresponding threads 20 of an elbow fitting 22 which may be connected, via a conduit (not shown) to a source of water under pressure.

The upper open end of the first outer housing 12 is formed with external threads 24 which are adapted to engage corresponding threads 26 of an end cap 28. The end cap 28 is formed with a central opening 30 for a purpose described below.

An intermediate substantially cylindrical housing 32 (also referred to herein as a second inner housing) is telescopically arranged within the first outer housing 12 for relative sliding movement into and out of the first housing, by way of opening 30 in the end cap 28. The inner housing 32 is provided with a radially outwardly directed flange 34 at its lowermost end, forming an annular retaining groove 36 for receiving the lowermost turn of a metal coil spring 38.

The second inner housing 32 terminates in an upper annular edge 40, defining an upper open end for receiving another inner housing 48 (also referred to herein as a first inner housing) as described below.

The coil spring 38 has a diameter slightly larger than the outer diameter of the second inner housing 32 and is concentrically located between the outer housing 12 and the second inner housing 32. The uppermost turn of coil spring 38 fits within an annular retaining groove 42 of an annular spring cap 44 located proximate to the end cap 28. An inverted U-shaped annular seal 46, preferably of a rubber or polymeric material, is fitted over the cap 42 and prevents dirt and debris from entering the housing 12 during extension and retraction of the inner housings as described below.

The first inner housing 48, also having a substantially cylindrical configuration, is telescopically mounted within an upper end of the second inner housing 32. The upper end of the first inner housing 48 terminates at a free edge 50.

The first inner housing 48 is provided with a lower flange 52 forming a groove 54 which receives the lowermost coil of a second metal coil spring 56, of lesser diameter and lesser axial length than spring 38.

The uppermost coil of spring 56 is received in a second spring cap 58 which supports a second inverted U-seal 60 which performs substantially the same function as seal 46. A radially inwardly directed flange 62 formed near the upper end of the second inner housing 32 provides an abutment surface for the spring cap 58 and seal 60. Thus, it will be appreciated that coil spring 56 urges the first inner housing 48 to a closed, inoperative position, with a radially outermost edge 61 of the distributor 80 sitting atop the edge 40 of the second inner housing 32 to further preclude entry of dirt or debris into the interior of the sprinkler.

The forces necessary to compress the springs 38 and 56 are adjusted so that upon introducing water under pressure into the sprinkler body, the second inner tubular housing 32 will be caused to extend out of the outer housing 12, but the relative positions of the first and second inner housings 48, 32 initially remain the same.

Additional water pressure will then cause the first inner housing 48 to extend out of the second inner housing 32 as shown in FIG. 1, with spring 56 under compression between flange 52 and spring cap 58. This represents a fully extended and operative sprinkling position for this double pop-up embodiment. Shut off of the water supply will result in a two stage retraction in reverse of the extension movement described above.

A cylindrical basket-type filter or screen 60 is arranged within the second inner housing 32, preferably by means of a press fit engagement between a lower annular flange 62 and the interior surface of the second inner housing 32. The cylindrical screen 60, also preferably constructed of a plastic material, is formed with an array of parallel, closely spaced slots 64, and is further provided with a centrally located, solid recessed area 66 at its upper end for a purpose described below.

A shaft 70 is mounted within the first inner housing 48. Specifically, the shaft is press fit within an elongated annular bushing or sleeve 72 which depends from an annular outlet end wall 74 of the first inner housing 48 located intermediate the upper free edge 50 and the lower flange 52. The shaft is thus prevented from rotation relative to the housing 48 and is formed with an enlarged head 76 which prevents the shaft from being removed from the housing in an upward direction.

A stator or drum 78 is fixedly secured (by press fit or other suitable means) to the other or upper end of the shaft 70. A substantially hollow distributor 80 is rotatably mounted on the shaft and encloses the drum or stator 78. A lower end of the distributor is formed to provide a shoulder or flange 82 which supports a thrust bearing 84 (preferably made of Teflon TM ) mounted on the shaft 70, and which facilitates rotation of the distributor about the shaft. The thrust bearing is prevented from axial movement on the shaft not only by the flange 82, but also by an annular flange 86 formed on or fixed to the shaft 70. In other words, thrust washer or bearing 84 is sandwiched between the flanges 82 and 86. A U-shaped seal 87 supported between the shaft 70 and distributor 80, above the flange 86, prevents escape of viscous fluid from the chamber 102 within the distributor.

A distributor cap 88 closes an upper end of the distributor, and is provided with an annular recess 90 for receiving the upper end of the shaft.

Distributor 80, as best seen in FIG. 2, has a generally conical configuration with a small diameter end 92 and a large diameter end 94. Bore 96 is formed in the small diameter end for receiving the upper end of shaft 70. In this manner, the exterior distributor surface 98 which is contacted by the water stream extends upwardly and outwardly relative to the shaft 70. This generally conical surface 98 is formed with a plurality of grooves or channels 100 extending between the small diameter end 92 and large diameter end 94. Each groove or channel 100 extends outwardly, but is slightly radially offset from the center or rotational axis of the distributor, so that a stream issuing from the discharge orifice impinging on the grooves 100 will cause the distributor 80 to rotate about the fixed shaft 70.

As a result of the conical configuration of the distributor 80, a similarly shaped chamber 102 is formed therein which serves as a viscous brake chamber which surrounds the generally similarly shaped stator or drum 78. The remaining clearance space between the drum or stator 78 and the interior walls of the chamber 102 is filled with a viscous fluid, preferably a viscous silicone fluid. The viscous shearing action resulting from relative rotation between the distributor 80 and drum 78 serves to retard the rotational speed of the distributor.

It will be appreciated that by locating the viscous brake assembly outside the sprinkler head, and by isolating the brake assembly within the distributor 80, there is no possibility of high pressure liquid gaining access to the interior viscous fluid containing chamber 102, thereby eliminating any need for high pressure dynamic seals typically required in known sprinkler constructions.

The nozzle disk 108 is formed with an outer cylindrical wall 110 and an end wall 112 provided with a central aperture 114 for permitting shaft 70 to pass therethrough. The end wall 112 is supported within a substantially cylindrical recess formed in the first inner housing 48 between the upper edge of the housing 48 and the outlet end wall 74.

An annular groove 116 is provided on the exterior, lower end of wall 110 in substantial vertical alignment with a similar groove 118 formed on the interior of housing 48. These grooves permit a split ring 120 or similar device to be utilized to secure the nozzle disk 108 to the inner housing 48, while permitting relative rotation between the two. Of course, other suitable means may be employed to mount the nozzle disk in the first inner housing.

The outlet end wall 74 of the inner housing 48 is provided with a first arcuate slot 122 which extends at least about 180° and preferably about 200° about the center of the stem (coinciding with the center axis of portions 12, 32 and 48 as well as the axis of the rotation of the distributor 80).

The nozzle disk 108 is provided with a second arcuate slot 124, which also extends slightly more than 180° about the same axis as the first arcuate slot 122. The first arcuate slot 122 has a width which is greater than the width of the second arcuate slot 124 as best seen in FIGS. 2, 4 and 5. At the same time, the centers of the arcuate slots 122 and 124 are radially aligned, so that slot 124 is locatable within the area of slot 122 as also best seen in FIGS. 2 and 5.

By this arrangement, the nozzle disk 108 is manually rotatable to align any arcuate portion of the slot 124 with fixed arcuate slot 122, to thereby permit adjustment of the sprinkling pattern to the desired arcuate extent of anywhere from zero to about 180°; the range of adjustment between the minimum and maximum being virtually infinite.

It will be appreciated that other nozzle disks may be provided to limit the range of adjustment. In addition, both arcuate slots 122 and 124 can be extended to expand the range to permit even greater adjustability.

With reference to FIG. 6, an alternative nozzle disk 108′ is shown, formed with a plurality of generally tear-drop shaped orifices 126, also radially aligned to fall within the width of slot 122. In this arrangement, the nozzle disk 108′ may be rotated to place the desired number of orifices within the fixed open slot 122.

It will be understood by those skilled in the art that the shape, number and spacing of orifices formed in the nozzle disk may be varied to provide the desired sprinkling pattern.

In operation, the nozzle disk 108 is initially rotated relative to the stationary inner housing 48 until the desired sprinkling pattern is set.

Upon commencement of flow of water under pressure into the sprinkler device via a conduit (not shown) and fitting 22, a flow path will extend through the interior of screen 60, through the screen slots 64, and then through the discharge slots 122, 124 and into engagement with channels 100 of distributor 80, causing the latter to rotate about the shaft 70. At the same time, the second inner housing or stem 32, and first inner housing 48 will be forced, against the action of spring 38, to an above ground position. As the second inner housing 32 moves upwardly, seal 46 engages the outer surface thereof, insuring that no foreign matter enters the interior of the sprinkler. Almost immediately thereafter, the first inner housing 48 will extend upwardly relative to housing 32, and against the action of spring 56 to a fully extended and operative position as shown in FIGS. 1 and 2. During such extension, seal 60 engages the outer surface of housing 48 in the same manner as seal 46 engages housing 32.

By reason of shearing of the viscous fluid between the fixed drum or stator 78 and the interior wall of the rotating distributor 80, effective braking of the rotor 80 is achieved. Specifically, it has been observed that an unbraked rotor will rotate, for a given water pressure, at about 1800 rpm. Under the same pressure conditions, the viscous brake of this invention will slow the rotor to a speed of between about ¼ rpm and about 12 rpm. By thus reducing the rotational speed of the rotor, maximum water throw is obtained, while minimizing the undesirable "horse tail" effects of the fluid stream under rotation.

When the water is "shut off", the inner housings 32 and 48 will automatically return to their inoperative position within housing 12 by reason of the expansion of springs 38 and 56, and seals 46 and 60 will again prevent entry of dirt or debris into the interior of the device.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pop-up, rotating stream sprinkler device comprising:

an outer housing having a first longitudinal axis, and an inlet end adapted for connection to a source of liquid under pressure;

a first inner housing telescopically mounted within said outer housing for movement between retracted and extended positions, and having a second longitudinal axis coincident with the first longitudinal axis, and an outlet end adapted to discharge a stream of liquid under pressure to atmosphere;

a non-rotatable shaft, one end of said shaft supporting a rotary distributor assembly for rotation thereon downstream of said outlet end, and the other end of said shaft mounted in said first inner housing, and wherein said distributor assembly is operatively associated with a brake for retarding rotation of said distributor; and further wherein said distributor assembly includes a substantially hollow portion defining an interior chamber, and said brake includes a stator mounted on said shaft and enclosed within said chamber, and further wherein said chamber contains a viscous fluid.

2. A pop-up, rotating stream sprinkler as defined in claim 1 and wherein said brake comprises a viscous brake capable of reducing rotational speed of said distributor from an unbraked speed of at least about 1800 rpm to within a range of about ¼ rpm. to about 12 rpm.

3. A pop-up, rotating stream sprinkler as defined in claim 1 wherein seal means are provided between said rotary distributor assembly and said shaft where said shaft enters said interior chamber.

4. A pop-up, rotating stream sprinkler as defined in claim 1, wherein said rotary distributor assembly is mounted for rotation about said shaft, and is further provided with a plurality of upwardly and outwardly extending grooves, each of which is slightly radially offset from said axes.

5. A pop-up, rotating stream sprinkler as defined in claim 1 and further including a second inner housing mounted telescopically between said outer housing and said first inner housing.

6. A pop-up, rotating stream sprinkler as defined in claim 5 and further comprising an end cap removably attached to the upper open end of the outer housing, said end cap having an opening therein for accommodating movement of said first and second inner housings into and out of said outer housing, said opening having a peripheral resilient seal mounted therein.

7. A pop-up, rotating stream sprinkler device comprising:

an outer housing having a substantially closed lower end and an open upper end, including an inlet in said closed lower end adapted for connection to a source of liquid under pressure;

a first inner housing telescopically and concentrically mounted within said outer housing, having an outlet end provided with a first arcuate slot adapted to discharge a stream of liquid under pressure;

a distributor mounted on one end of a shaft for rotation relative thereto, said distributor located downstream of said outlet; and a nozzle disk rotatably secured to said first inner housing and provided with at least one discharge orifice, wherein said nozzle is rotatable to align any part of said at least one discharge orifice with said first arcuate slot.

8. A pop-up rotating stream sprinkler as defined in claim 7 and wherein said discharge orifice is in the form of a second arcuate slot, and wherein said first arcuate slot has a width greater than a corresponding width of said second arcuate slot.

9. A pop-up, rotating stream sprinkler as defined in claim 8 wherein said second arcuate slot extends at least about 180°.

10. A pop-up, rotating stream sprinkler as defined in claim 8 wherein said first and second arcuate slots extend more than 180° about a longitudinal axis of said sprinkler.

11. A pop-up, rotating stream sprinkler as defined in claim 7 wherein said first arcuate slot extends at least about 180°.

12. A pop-up, rotating stream sprinkler as defined in claim 7 wherein said nozzle disk is secured to said first inner housing by a resilient split ring.

13. A pop-up, rotating stream sprinkler as defined in claim 7 wherein said nozzle disk is provided with a plurality of discharge orifices arranged in an arcuate pattern.

14. A pop-up, rotating stream sprinkler as defined in claim 7 and further including a spring located between said outer and first inner housings, normally biasing said first inner housing to a retracted inoperative position within said outer housing, and wherein said first inner housing is adapted to extend out of said outer housing to an extended position in response to liquid under pressure flowing into the sprinkler.

15. A pop-up, rotating stream sprinkler as defined in claim 7 and further including a second inner housing mounted telescopically between said outer housing and said first inner housing, said first and second inner housings adapted to extend together out of said outer housing under liquid pressure and said first inner housing adapted to thereafter extend out of said second inner housing under further exposure to said liquid pressure.

16. A pop-up, rotating stream sprinkler as defined in claim 7 wherein said rotary distributor includes multiple grooves for altering the direction of flow of liquid from a substantially vertical path to a radially outwardly directed path.

17. A pop-up, rotating stream sprinkler device comprising:

an outer housing having a first longitudinal axis, and an inlet end adapted for connection to a source of liquid under pressure;

a first inner housing telescopically mounted within said outer housing for movement between retracted and extended positions, and having a second longitudinal axis coincident with the first longitudinal axis, and an outlet end provided with a first arcuate slot adapted to discharge a stream of liquid under pressure;

a non-rotatable shaft, one end of said shaft supporting a distributor for rotation thereon downstream of said outlet, and the other end of said shaft mounted in said first inner housing, said distributor being operatively associated with a brake assembly for retarding the rotation of said distributor; and a nozzle disk rotatably secured to said first inner housing and provided with at least one discharge orifice, and wherein said nozzle is rotatable to align any part of said at least one discharge orifice with said first arcuate slot.

18. A pop-up, rotating stream sprinkler as defined in claim 17 and wherein said brake assembly comprises a viscous brake capable of reducing rotational speed of said distributor from an unbraked speed of at least about 1800 rpm to within a range of about ¼ rpm. to about 12 rpm.

19. A pop-up rotating stream sprinkler as defined in claim 18 wherein said distributor is substantially hollow and defines an interior chamber, and a stator is mounted on said shaft in said chamber, and further wherein said chamber contains a viscous fluid.

20. A pop-up, rotating stream sprinkler as defined in claim 19 wherein seal means are provided between said distributor and said shaft where said shaft enters said interior chamber.

21. A pop-up rotating stream sprinkler as defined in claim 17 and wherein said discharge orifice is in the form of a second arcuate slot, and wherein said first arcuate slot has a width greater than a corresponding width of said second arcuate slot.

22. A pop-up, rotating stream sprinkler as defined in claim 21 wherein said first arcuate slot extends at least about 180°.

23. A pop-up, rotating stream sprinkler as defined in claim 21 wherein said second arcuate slot extends at least about 180°.

24. A pop-up, rotating stream sprinkler as defined in claim 21 wherein said first and second arcuate slots extend more than 180° about said longitudinal axis.

25. A pop-up, rotating stream sprinkler as defined in claim 17 and further including a second inner housing mounted telescopically between said outer housing and said first inner housing, said first and second inner housings adapted to extend together out of said outer housing under liquid pressure and said inner housing adapted to thereafter extend out of said second inner housing under further exposure to said liquid pressure.

26. A rotating stream sprinkler comprising:

a sprinkler body having a discharge nozzle for discharging a stream to atmosphere;

a distributor assembly having a substantially hollow body portion defining an interior brake chamber, said distributor assembly provided with exterior stream distributing surfaces located downstream of said nozzle, said distributor assembly mounted for rotation on one end of a non-rotating shaft, said one end of said shaft terminating within a closed end of said distributor the other end of said shaft extending out of the distributor assembly in an upstream direction and into said sprinkler body;

a stator member fixedly secured to said one end of said shaft within said substantially hollow body portion; and a viscous fluid within said brake chamber for effecting braking action on said distributor assembly upon relative motion between said hollow body portion and said stator member.

27. A rotating stream sprinkler as defined in claim 26, said stator member has wall surfaces which substantially conform to interior surfaces of said brake chamber.

28. A rotating stream sprinkler as defined in claim 26 wherein said stream distribution surfaces direct water upwardly and radially outwardly relative to said sprinkler body, said surfaces further being arranged relative to said shaft so that liquid under pressure impinging on said surfaces will cause said distributor to rotate about said shaft.

29. A rotating stream sprinkler comprising:

a sprinkler body having a discharge nozzle adapted to discharge a stream to atmosphere; a distributor rotatably mounted on one end of a non-rotating shaft, said one end of said shaft terminating within a closed end of said distributor, the other end of said non-rotating shaft being secured within said sprinkler body such that said discharge nozzle at least partially surrounds said shaft; said distributor having a substantially hollow body portion and said one end of said non-rotating shaft having a stationary stator secured thereto within said hollow body portion; said hollow body portion having a viscous fluid therein for creating a braking action on said distributor upon relative rotation between said hollow body portion and said stator.

30. A pop-up, rotating stream sprinkler device comprising:

an outer housing having a first longitudinal axis, and an inlet end adapted for connection to a source of liquid under pressure;

a first inner housing telescopically mounted within said outer housing for movement between retracted and extended positions, and having a second longitudinal axis coincident with the first longitudinal axis, and an outlet end adapted to discharge a stream of liquid under pressure to atmosphere;

a non-rotatable shaft, one end of said shaft supporting a rotary distributor for rotation thereon downstream of said outlet end, and the other end of said shaft mounted in said first inner housing, and wherein said distributor is operatively associated with a brake assembly for retarding rotation of said distributor; wherein said rotary distributor is mounted for rotation about said shaft, and is further provided with a plurality of upwardly and outwardly extending grooves arranged relative to said shaft so that liquid under pressure impinging on said surfaces will cause said distributor to rotate about said shaft.

* * * * *